US008203414B2

(12) United States Patent
Tao et al.

(10) Patent No.: US 8,203,414 B2
(45) Date of Patent: Jun. 19, 2012

(54) TRANSFORMER INCLUDING HIGH VOLTAGE POLE AND ELECTRICAL CONNECTION TO LOAD

(75) Inventors: Yu-Sheng Tao, Jhongli (TW); Chih-Chan Ger, Jhongli (TW); Lien-Fu Chien, Jhongli (TW)

(73) Assignee: Ampower Technology Co., Ltd., Jhongli, Taoyuan County (TW)

( * ) Notice: Subject to any disclaimer, the term of this patent is extended or adjusted under 35 U.S.C. 154(b) by 0 days.

(21) Appl. No.: 12/873,275

(22) Filed: Aug. 31, 2010

(65) Prior Publication Data

US 2012/0038447 A1 Feb. 16, 2012

(30) Foreign Application Priority Data

Aug. 12, 2010 (CN) ..... 2010 2 0289385 U

(51) Int. Cl.
*H01F 27/29* (2006.01)
*H01F 27/30* (2006.01)
*H01F 27/28* (2006.01)

(52) U.S. Cl. ..... 336/192; 336/198; 336/208; 336/170

(58) Field of Classification Search ..... 336/192, 336/198, 208, 170, 182
See application file for complete search history.

(56) References Cited

U.S. PATENT DOCUMENTS

| | | | | |
|---|---|---|---|---|
| 2007/0024406 | A1* | 2/2007 | Hao | 336/208 |
| 2010/0214049 | A1* | 8/2010 | Park et al. | 336/170 |
| 2010/0253458 | A1* | 10/2010 | Chen et al. | 336/170 |

* cited by examiner

*Primary Examiner* — Lincoln Donovan
*Assistant Examiner* — Mangtin Lian
(74) *Attorney, Agent, or Firm* — Altis Law Group, Inc.

(57) ABSTRACT

A transformer can be mounted on a circuit board. The circuit board includes a high-voltage line and a load. The transformer includes a bobbin used for winding a coil. The bobbin includes a first secondary area. A first secondary high voltage pole extends from the first secondary area. A first secondary high voltage pin is fixed on an end of the first secondary high voltage pole away from the first secondary area. The bobbin is made of an insulator. The first secondary high voltage pin is made of a conductor. The high voltage end of the coil is disposed on a top surface of the first secondary high voltage pole and electrically connected to the first secondary high voltage pin. The first secondary high voltage pole is capable of jumping across the high-voltage line to make the first secondary high voltage pin to electrically connect to the load.

9 Claims, 5 Drawing Sheets

TRANSFORMER INCLUDING HIGH VOLTAGE POLE AND ELECTRICAL CONNECTION TO LOAD

BACKGROUND

1. Technical Field

The present disclosure relates to a transformer including a high voltage pole and an electrical connection to a load.

2. Description of Related Art

A backlight module of a display employs a number of cold cathode fluorescent lamps (CCFLs) as light sources. The CCFLs need to be triggered by a high-voltage alternative current (AC). Therefore, a printed circuit board (PCB) with a transformer is used for transforming a low-voltage AC into a high-voltage AC. In current PCBs, the transformer and the CCFL lie on opposite sides of a high-voltage line of the PCB. A secondary high voltage pin of the transformer extends across the high-voltage line through a jumper and is then electrically connected to the CCFL. However, the employment of the jumper increases the quantity of elements on the PCB and makes the PCB complex. Additionally, the jumper can be easily damaged, which will adversely affect the performance of the backlight module.

Therefore, it is desirable to provide a transformer including high voltage pole and electrical connection to load that can overcome the above-mentioned limitations.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Figure 1:
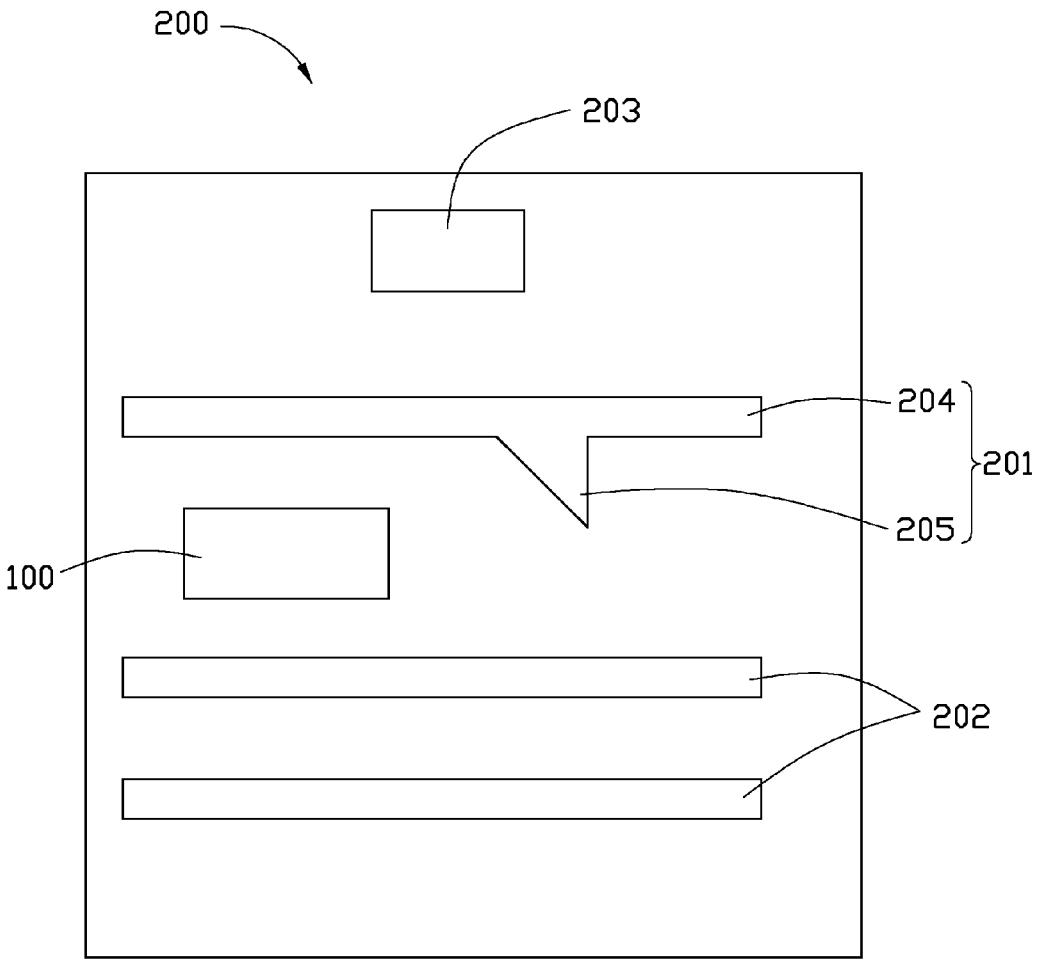
FIG. 1 is a schematic view of a printed circuit board, according to an exemplary embodiment.

Referring to FIG. 1, a printed circuit board (PCB) 200 includes a high-voltage line 201, two low-voltage lines 202 and a load 203. The high-voltage line 201 is tree-shaped and includes a main-line 204 and a branch-line 205 extending outward from the main-line 204. In this embodiment, the load 203 can be a cold cathode fluorescent lamp (CCFL). The two low-voltage lines 202 are substantially parallel to the main-line 204.

Figure 2:
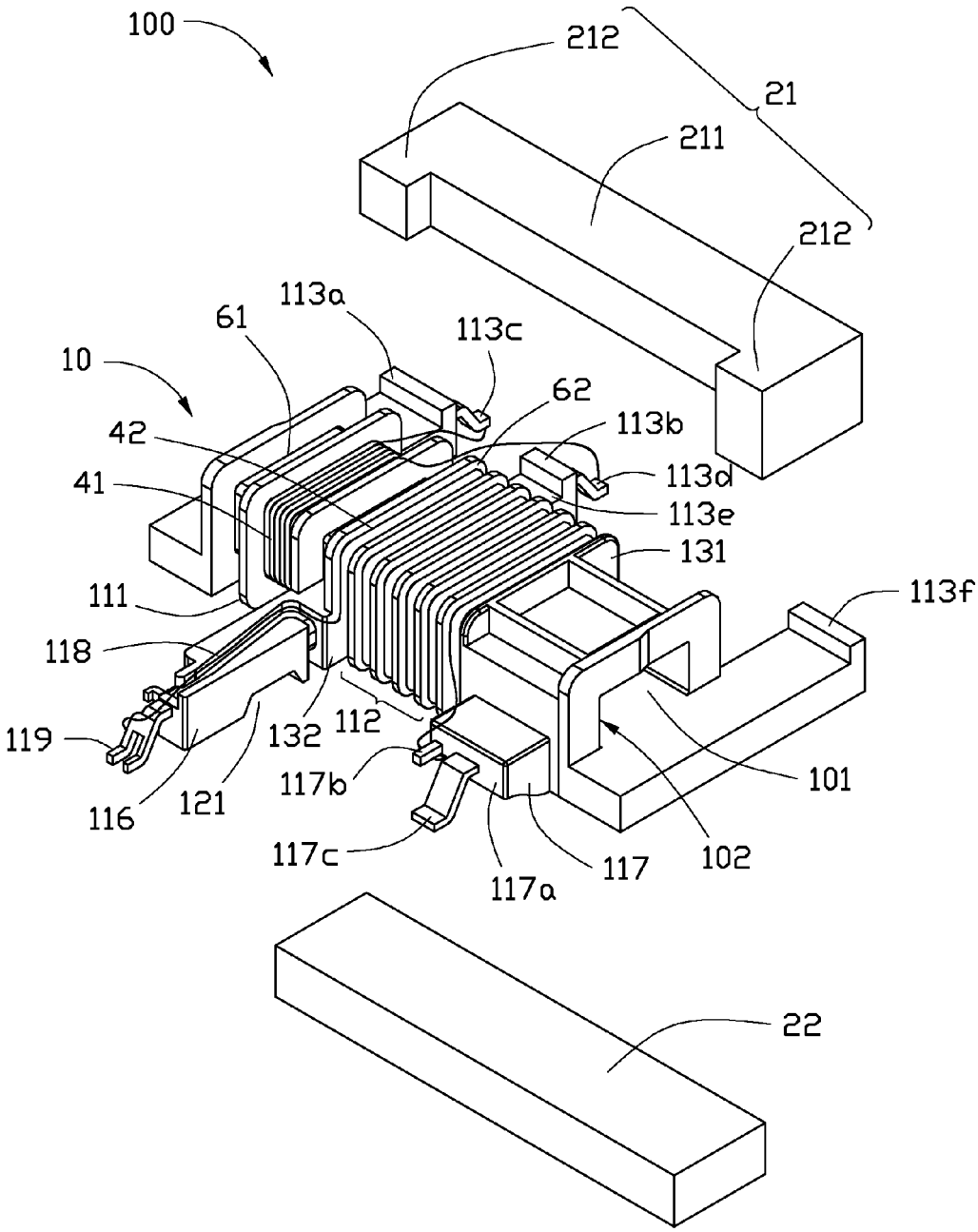
FIG. 2 is an isometric, exploded view of a transformer including high voltage pole and electrical connection to load, according to a first embodiment.
Figure 3:
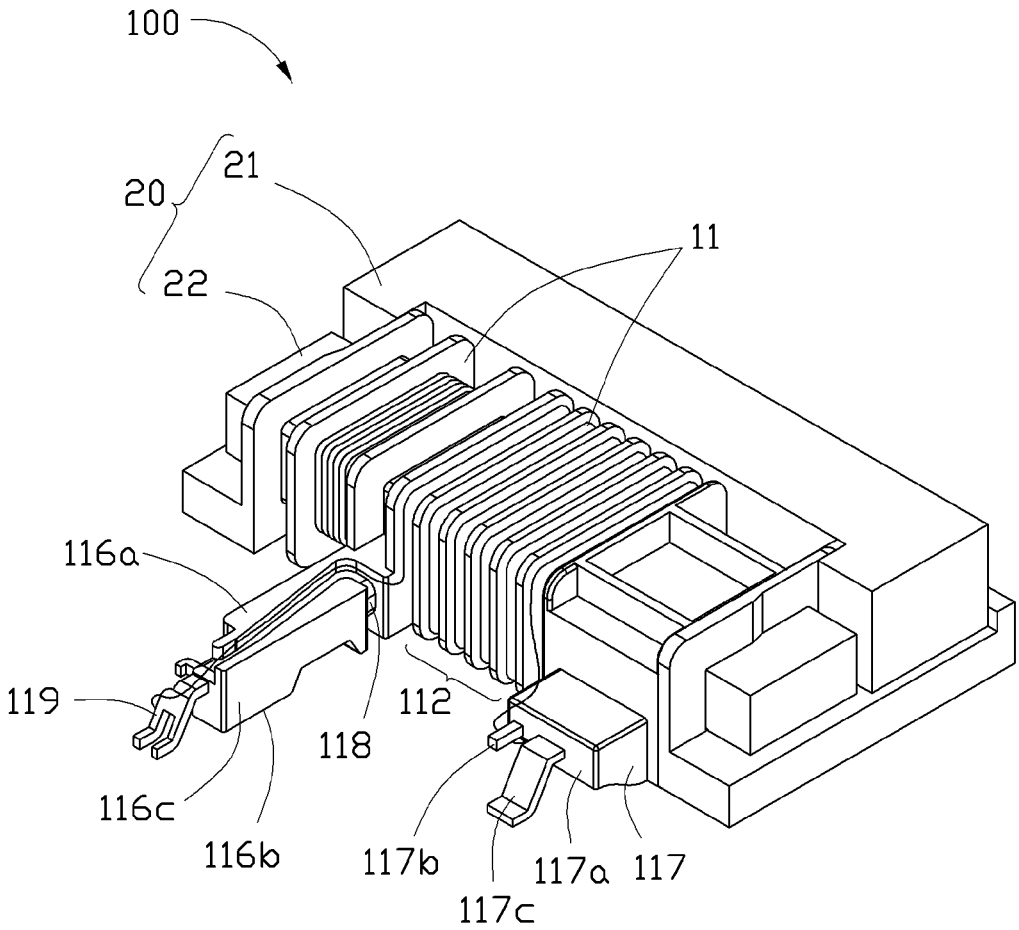
FIG. 3 is an isometric, assembled view of the transformer of FIG. 2.

Referring to FIGS. 2-3, a transformer including high voltage pole and electrical connection to load 203, according to a first embodiment, is mounted on the PCB 200 and transforms an input low-voltage AC from the two low-voltage lines 202 into a high-voltage AC, and then provides the high-voltage AC to the load 203. The transformer 100 includes a bobbin 10 and a solenoid core assembly 20. In this embodiment, the transformer 100 is positioned between the main-line 204 and the one low-voltage line 202 adjacent to the main-line 204.

The bobbin 10 defines a through hole 101 passing through two opposite end surfaces of the bobbin 10 and forms two openings 102 at the two opposite end surfaces. The bobbin 10 is made of an insulator and includes a first portion 11, a first sidewall 131 and a second sidewall 132 opposite to the first sidewall 131. The first portion 11 includes a first primary area 111, a first secondary area 112, a first primary high voltage pole 113*a*, a first primary low voltage pole 113*b*, a first secondary high voltage pole 116, and a first secondary low voltage pole 117.

The first secondary area 112 extends along the longitudinal direction of the first primary area 111. The first primary area 111 defines a number of primary trenches 61 for winding a number of primary coils 41. The first secondary area 112 defines a number of second trenches 62 for winding a number of secondary coils 42. In this embodiment, the number of the primary trenches 61 of the first primary area 111 is more than the number of the secondary trenches 62 of the first secondary area 112. In other alternative embodiment, if the transformer transforms the high-voltage AC into the low-voltage AC, the number of the primary trenches 61 of the first primary area 111 is less than the number of the secondary trenches 62 of the first secondary area 112.

The first primary high voltage pole 113*a* and the first primary low voltage pole 113*b* extend from the first sidewall 131. A first primary high voltage pin 113*c* and a first primary low voltage pin 113*d* are respectively disposed on the end surfaces of the first primary high voltage pole 113*a* and the first primary low voltage pole 113*b* away from the first primary area 111. The first primary high voltage pin 113*c* and the first primary low voltage pin 113*d* are made of a conductor and are electrically connected to the two low-voltage lines 202, respectively. Two ends of the primary coil 41 of the bobbin 10 are wound around the first primary area 111 respectively extending along the first primary high voltage pole 113*a* and the first primary low voltage pole 113*b*, and are then respectively electrically connected to the first primary high voltage pin 113*c* and the first primary low voltage pin 113*d*. In this embodiment, the first primary high voltage pole 113*a* and the first primary low voltage pole 113*b* both define a receiving groove 113*e* along the longitudinal direction of the bobbin 10. The position of the first primary high voltage pole 113*a* and the first primary low voltage pole 113*b* are not limited to this embodiment. In other alternative embodiments, the first primary high voltage pole 113*a* and the first primary low voltage pole 113*b* can also extend from other portions of the bobbin 10 according to the location of the two low-voltage lines 202, for example, when the two low-voltage lines 202 are disposed near the second sidewall 132, the first primary high voltage pole 113*a* and the first primary low voltage pole 113*b* can extend from the second sidewall 132.

In this embodiment, the first primary high voltage pole 113*a* and the first primary low voltage pole 113*b* are perpendicular to the longitudinal direction of the bobbin 10. In other alternative embodiments, the first primary high voltage pole 113*a* and the first primary low voltage pole 113*b* can be inclined to the longitude of the bobbin 10.

The first secondary high voltage pole 116 and the first secondary low voltage pole 117 extend from the second sidewall 132. The first secondary high voltage pole 116 is disposed between the first primary area 111 and the second secondary area 112. The first secondary low voltage pole 117 is disposed on the end of the first secondary area 112 away from the first primary area 111.

A first secondary high voltage pin 119 is made of a conductor and is disposed on the end surface of the first secondary high voltage pole 116 away from the first secondary area 112. The first secondary high voltage pin 119 is electrically connected to the load 203. The first secondary high voltage pole 116 includes a top surface 116*a* away from the PCB 200, a bottom surface 116*b* opposite to the top surface 116*a* and a sidewall 116*c*. The sidewall 116*c* connects the first surface 116*a* and the second surface 116*b*, and near the first secondary area 112. The second surface 116*b*defines a slot 118 for receiving the high voltage end of the secondary coil 42 wound around the first secondary area 112, and introduces the high voltage end of the secondary coil 42 to the first secondary high voltage pin 119 and electrically connects thereto. The bottom surface 116*b* defines a concave 121 corresponding to the main-line 204, and thus the concave 121 is received over the main-line 204 to keep the high voltage end of the secondary coil 42 separate from the main-line 204.

In this embodiment, the slot 118 is L-shaped and extends from the sidewall 116*c* to the top surface 116*a*. But the shape and the configuration of the slot 118 are not limited to this embodiment. Any configuration that allows the high voltage end of the secondary coil 42 wind around the first secondary area 112 that can be introduced to the first secondary high voltage pin 116 along a surface away from the PCB 200 can be used instead. And the slot 118 also can be omitted, and the secondary coil 42 can be fixed by another means (e.g. gluing or soldering).

A first secondary low voltage pin 117*b* and a fixing pin 117*c* are disposed on an end surface 117*a* of the first secondary low voltage pole 117 away from the first secondary area 112. The fixing pin 117*c* is electrically connected to the first secondary low voltage pin 117*b* and fixes the transformer 100 onto the branch-line 205. In other embodiments, the fixing pin 117*c* also can be omitted, and the first secondary low voltage pin 117*b* can be directly and electrically fixed onto the branch-line 205.

In still other embodiments, the first secondary low voltage pole 117 can be omitted, and the first secondary low voltage pin 117*b* and the fixing pin 117*c* are directly disposed on the end of the first secondary area 112 away from the first primary area 111.

The location of the first secondary high voltage pole 116 and the first secondary low voltage pole 117 are not limited to this embodiment. In yet still other embodiments, the first secondary high voltage pole 116 and the first secondary low voltage pole 117 can also extend from other portions of the bobbin 10 according the location of the load 203 and the branch-line 205. Such as, when the load 203 and the branch-line 205 are disposed near the first sidewall 131, the first secondary high voltage pole 116 and the first secondary low voltage pole 117 can also extend from the first sidewall 131.

The solenoid core assembly 20 includes a first solenoid core 21 and a second solenoid core 22. The first solenoid core 21 is U-shaped and includes a main-body 211 and two first protrusions 212 perpendicular to the longitudinal direction of the main-body 211. The main-body 211 is received in the first groove 113*e*. The two first protrusions 212 are distorted respectively with the two openings 102. The second solenoid core 22 is I-shaped and is received in the through-hole 101, and the two ends of the second solenoid core 22 extend from the two openings 102 and adjacent to the two protrusions 212 respectively, and thus form a closed magnetic circuit. The first solenoid core 21 and the second solenoid core 22 are made of highly magnetic conductive material. In this embodiment, the first solenoid core 21 is made of manganese zinc alloy. The second solenoid core 22 is made of nickel zinc alloy. In other embodiments, the first groove 113*e* can be omitted, and the first solenoid core 21 can be fixed on the bobbin 10 using other style (e.g. gluing or soldering).

In use, the transformer 100 is mounted on the PCB 200. The first primary high voltage pin 113*c* and the first primary low voltage pin 113*d* are electrically fixed respectively to the two low-voltage lines 202. The first secondary high voltage pole 116 is capable of jumping across the main-line 204 to make the first secondary high voltage pin 119 to electrically connected to the load 203. The fixing pin 117*c* is electrically fixed to the branch-line 205. Therefore, the transformer 100 transforms the low-voltage AC from the PCB 200 to a high-voltage AC and provides the high-voltage AC to the load 203.

Figure 4:
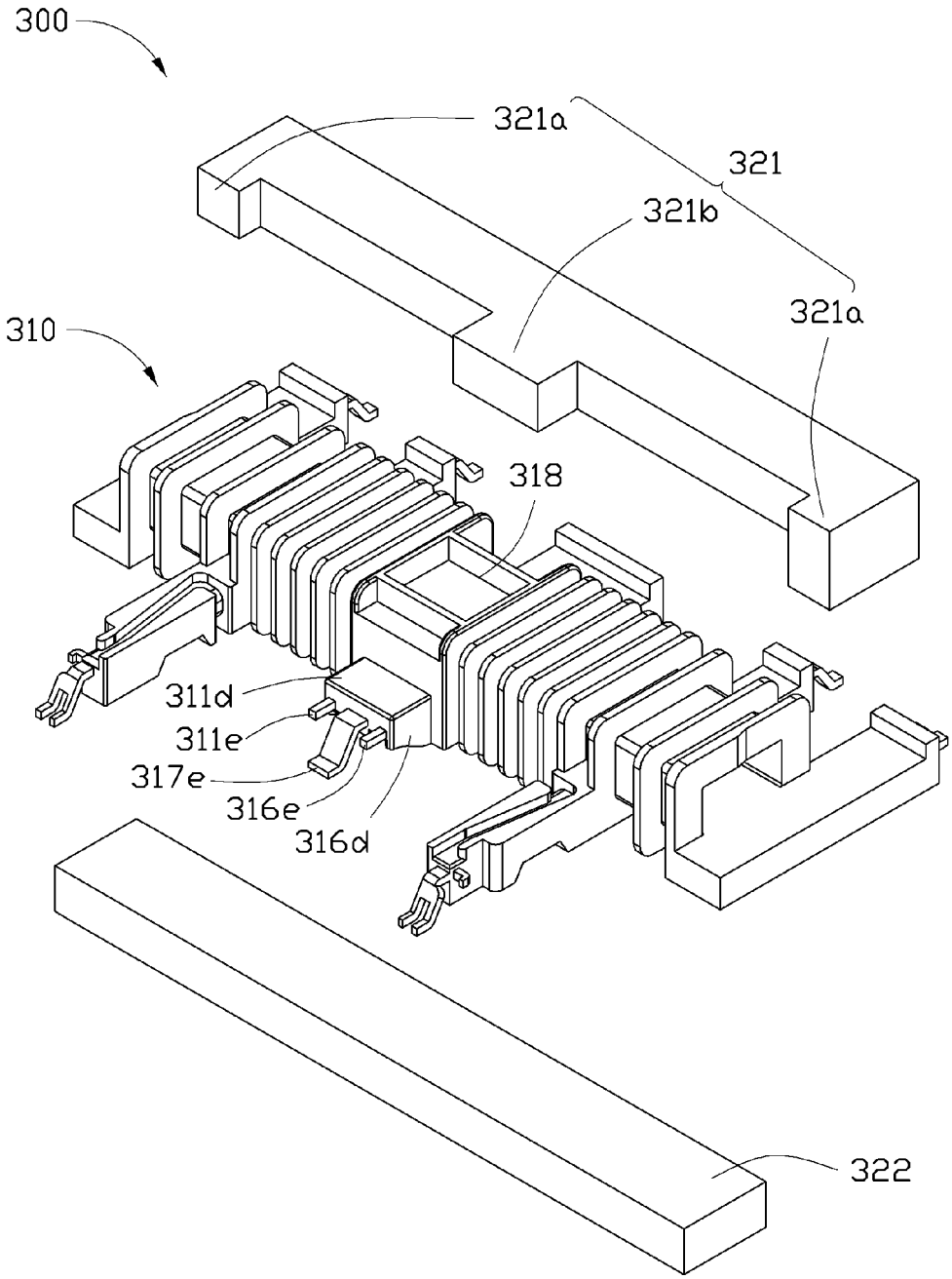
FIG. 4 is an isometric, exploded view of a transformer, according to a second embodiment.
Figure 5:
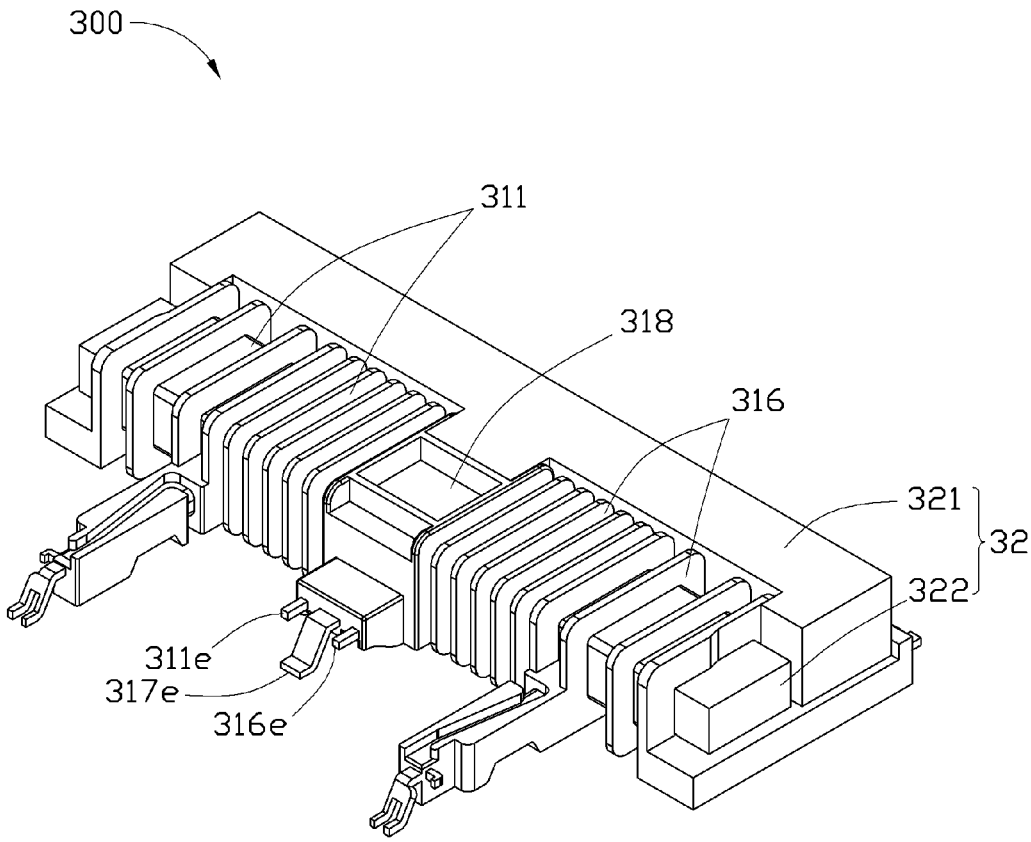
FIG. 5 is an isometric, assembled view of the transformer of FIG. 4.

Also referring to FIG. 4 and FIG. 5, a transformer 300 according to a second embodiment, includes a bobbin 310. The bobbin 310 includes a first portion 311, a second portion 316 and a spacing portion 318. The configuration of the first portion 311 and the second portion 316 are axially symmetry with the spacing portion 318. The second secondary low voltage pole 316*d* is integrally formed with the first secondary low voltage pole 311*d*. And the secondary low voltage pin 316*e* and the first secondary low voltage pin 311*e* both are electrically connected to the fixing pin 317*e*. In addition, the second secondary low voltage pin 316*e* is substantially parallel to the first secondary low voltage pin 311*e*. In other embodiments, the second secondary low voltage pin 316*e* also can be perpendicular to the first secondary low voltage pin 311*e* according the location of the branch-lines 205.

The first solenoid core 321 is E-shaped and includes two first protrusions 321*a* and a second protrusion 321*b* substantially parallel to the two first protrusions 321*a*. The second protrusion 321*b* resists one sidewall of the spacing portion 318, and thus the solenoid core assembly 32 can form two close magnetic circuits.

In other embodiments, the configuration of the second portion 316 also can be same as that of the first portion 311 (i.e. one end of the spacing portion 318 connects a first portion 311). Moreover, the other end of the spacing portion 318 connects a second portion 312), and more than one second portions 312 may be employed based on need. This configuration of the transformer 300 can integrate a number of single transformers to reduce production cost.

It will be understood that the above particular embodiments and methods are shown and described by way of illustration only. The principles and the features of the present disclosure may be employed in various and numerous embodiments thereof without departing from the scope of the disclosure as claimed. The above-described embodiments illustrate the scope of the disclosure but do not restrict the scope of the disclosure.

What is claimed is:

1. A transformer for on a circuit board, the circuit board comprising a high-voltage line and a load, wherein the high-voltage line is positioned between the transformer and the load;

the transformer comprising:

a bobbin comprising a first secondary area configured for winding a secondary coil thereon, wherein the bobbin is made of an insulator, the secondary coil comprising a high voltage end and a low voltage end;

a first secondary high voltage pole extending from the first secondary area;

a first secondary high voltage pin fixed on an end of the first secondary high voltage pole away from the first secondary area and made of a conductor;

a first secondary low voltage pole extending from the first secondary area, and separated from the first secondary high voltage pole;

a first secondary low voltage pin positioned on one end surface of the first secondary low voltage pole away from the bobbin, and electrically connected to the high-voltage line;

wherein the first secondary high voltage pole and the first secondary low voltage pole are positioned on two opposite ends of the first secondary area, length of the first secondary high voltage pole is greater than length of the first secondary low voltage pole, the high voltage end of the secondary coil is disposed on a top surface of the first secondary high voltage pole and electrically connected to the first secondary high voltage pin and positioned such that the first secondary high voltage pole is capable of jumping across the high-voltage line to make the first secondary high voltage pin electrically connect to the load, the low voltage end of the secondary coil is electrically connected to the first secondary low voltage pin along the first secondary low voltage pole.

2. The transformer of claim 1, wherein the first secondary high voltage pole comprises a bottom surface opposite to the top surface and a concave received over the high-voltage line.

3. The transformer of claim 1, wherein the bobbin comprises a first primary area along the longitudinal direction of the first secondary area, the first primary area and the first secondary area includes a first portion, the first secondary high voltage pole extends outward from a space between the first primary area and the first secondary area.

4. The transformer of claim 1, wherein the first secondary high voltage pole extends perpendicular to the bobbin.

5. The transformer of claim 1, wherein a fixing pin is positioned on the end surface of the first secondary low voltage pole for mounting the transformer onto the PCB.

6. The transformer of claim 3, wherein the transformer further comprises a second portion and a spacing portion, the configuration of the second portion and the first portion are axial symmetric with the spacing portion.

7. The transformer of claim 3, wherein the bobbin further comprises a second portion, and the configuration of the second portion is same as that of the first portion.

8. The transformer of claim 6, wherein a first secondary low voltage pin is disposed on the first portion, a second secondary low voltage pin is disposed on the second portion, and the second secondary low voltage pin is substantially parallel to the first secondary low voltage pin.

9. The transformer of claim 7, wherein a first secondary low voltage pin is disposed on the first portion, a second secondary low voltage pin is disposed on the second portion, and the second secondary low voltage pin is substantially parallel to the first secondary low voltage pin.

* * * * *